US006962453B2

(12) United States Patent
Hirota et al.

(10) Patent No.: US 6,962,453 B2
(45) Date of Patent: Nov. 8, 2005

(54) IMAGE-FORMING APPARATUS AND IMAGE-FORMING METHOD

(75) Inventors: Makoto Hirota, Tokyo (JP); Tsuyoshi Yagisawa, Kanagawa (JP); Tetsuo Kosaka, Yamagata (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/055,254

(22) Filed: Feb. 10, 2005

(65) Prior Publication Data

US 2005/0147439 A1 Jul. 7, 2005

Related U.S. Application Data

(62) Division of application No. 10/718,382, filed on Nov. 19, 2003, now Pat. No. 6,877,921.

(30) Foreign Application Priority Data

Nov. 22, 2002 (JP) ..... 2002-339757

(51) Int. Cl.[7] ..... B41J 11/58
(52) U.S. Cl. ..... 400/625; 399/404; 399/405
(58) Field of Search ..... 400/625, 61, 62, 400/70, 76; 358/1.12–1.15, 1.9; 270/58.31–58.34; 399/382, 404, 405

(56) References Cited

U.S. PATENT DOCUMENTS 5,848,346 A * 12/1998 Takashiro ..... 399/404
5,897,250 A * 4/1999 Hirai et al. ..... 399/404
6,089,559 A * 7/2000 Steinhilber ..... 270/58.31
6,227,531 B1 * 5/2001 Guerrero et al. ..... 270/58.31

* cited by examiner

*Primary Examiner*—Minh Chau
(74) *Attorney, Agent, or Firm*—Canon U.S.A. Inc., I.P. Division

(57) ABSTRACT

The present invention is characterized in that: a demanded printing-job is accepted at a printing-job accepting unit, and a printing executing unit executes printing according to the accepted printing-job so as to produce an output sheet onto a discharge tray; an output-sheet detecting unit detects the presence of a printed output-sheet on the discharge tray; if the removal of discharged sheets from the discharge tray is detected, a printed-sheet mixture determining unit determines the possibility that sheets printed corresponding to a plurality of demands are mixed among the removed output-sheets; and if it is determined the possibility that sheets printed corresponding to a plurality of the demands are mixed among the output-sheets, warning information is produced by a warning voice producing unit.

14 Claims, 5 Drawing Sheets

FIG. 5A
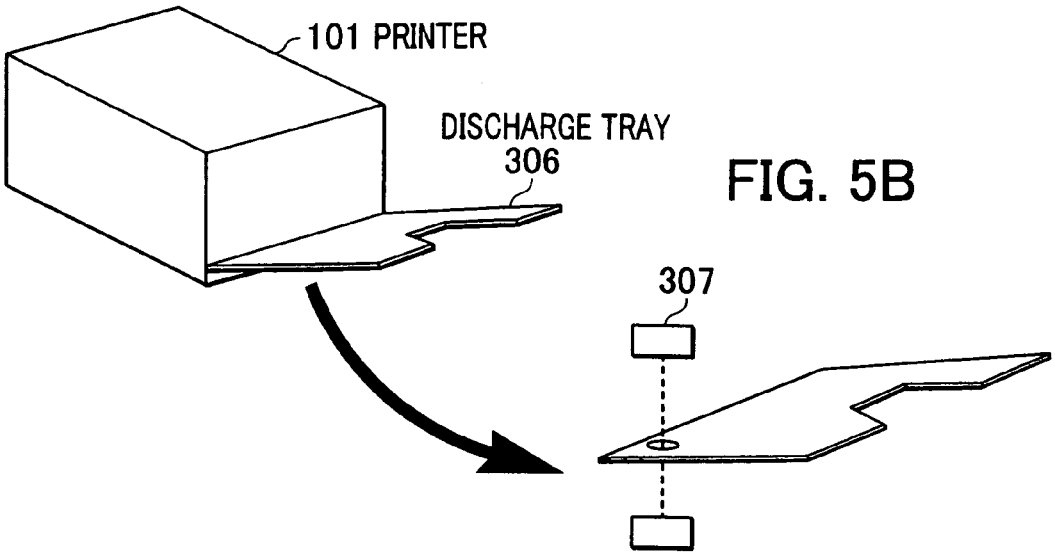
FIG. 5B
FIG. 6
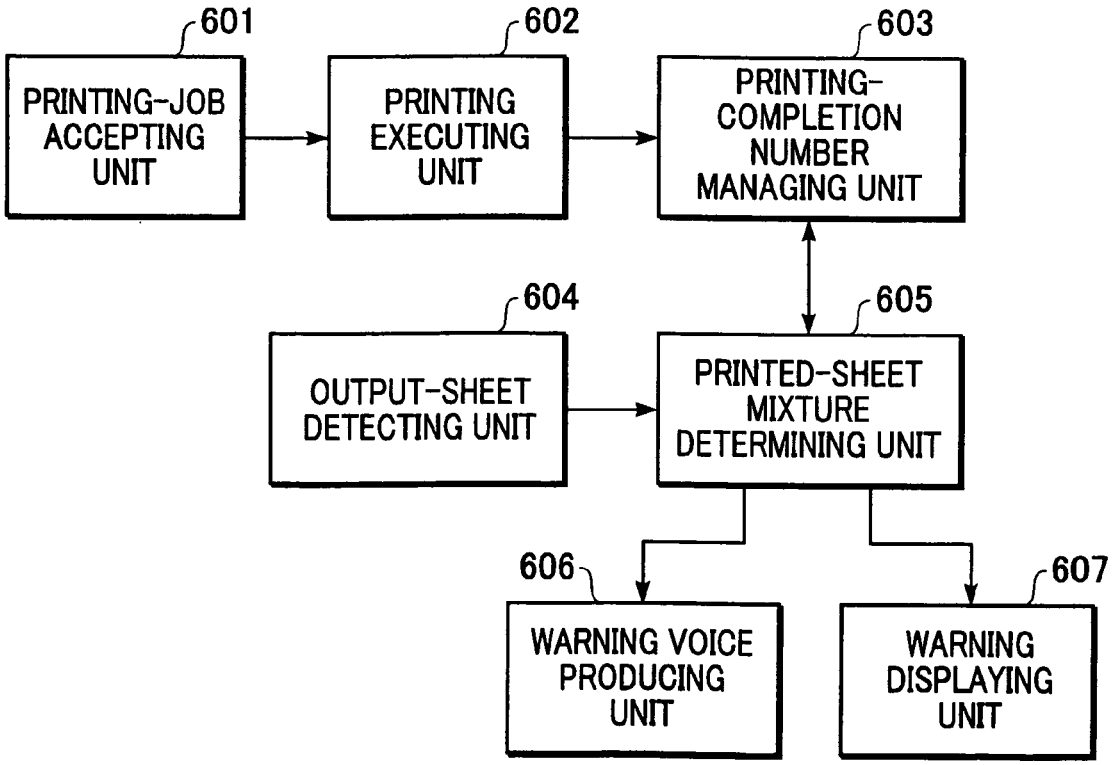

IMAGE-FORMING APPARATUS AND IMAGE-FORMING METHOD

CROSS-REFERENCE TO RELATED APPLICATIONS

This application is a division of application Ser. No. 10/718,382, filed Nov. 19, 2003, now U.S Pat. No. 6,877,921, the contents of which are incorporated herein by reference.

BACKGROUND OF THE INVENTION

1. Field of the Invention

The present invention relates to an image-forming apparatus and an image-forming method having a warning function to inform a user that output sheets printed corresponding to a plurality of demanded printing-jobs are mixed among the printed output sheets discharged on a discharge tray.

2. Description of the Related Art

A printer connected to a plurality of personal computers (PCs) via a network accepts printing-jobs demanded from the plurality of PCs, and prints these jobs in order of arrival so as to discharge the printed output sheets on the discharge tray. Therefore, on the discharge tray of the printer, output sheets printed corresponding to a plurality of printing-job demands may be discharged in piles, so that there is a risk that a user of each PC, who comes to bring printed sheets (output sheets), may bring back the printed sheets without knowing the mixture of another user's output sheet.

On the other hand, in a facsimile (FAX), output sheets addressed to various receivers from various senders may also be mixed on the discharge tray in the same way as that of the printer.

In order to solve such a problem, there have been patent documents such as Japanese Patent Laid-Open No. 8-317123, in which a facsimile has a sorter function to have a plurality of sorter bins so as to prevent a user from bringing back an output sheet addressed for another user in mistake by displaying or informing with voice the sender and receiver information when the user is to bring received sheets out of the bin.

However, if there is only one discharge tray for discharging output sheets thereon, a problem cannot be avoided, in which output sheets printed corresponding to a plurality of printing demands are mixed on the discharge tray. Therefore, there is an unsolved problem that a user may bring output sheets back without knowing that an output sheet for another user is mixed therewith. In particular, for a visually impaired user, an output sheet cannot be visually confirmed, so that it has been very difficult to determine the possibility that output sheets printed corresponding to a plurality of printing demands are mixed on the discharge tray.

On the other hand, according to the above-mentioned patent document, a facsimile is required to have a plurality of sorter bins and a sensor for each sorter for detecting that a received document is brought out, so that there has been a disadvantage of high cost.

SUMMARY OF THE INVENTION

The present invention has been made in view of such situations and it is an object of thereof to provide an image-forming apparatus and an image-forming method capable of readily informing presence of the possibility that an output sheet for another user is mixed among the printed output sheets brought out of a discharge tray of a printer, etc.

An image-forming apparatus according to the present invention comprises printing-job accepting means for accepting a demanded printing job; printing executing means for executing printing according to the accepted printing-job demand so as to produce an output sheet onto a discharge tray; output-sheet detecting means for detecting the presence of the printed output sheet on the discharge tray; printed-sheet mixture determining means for determining possibility that sheets printed by corresponding to a plurality of demands are mixed among the discharged output sheets when the output-sheet detecting means detects the removal of discharged sheets from the discharge tray; and printed-sheet mixture warning means for producing warning information if the printed-sheet mixture determining means determines the possibility that sheets printed by corresponding to a plurality of demands are mixed among the discharged output-sheets.

Further objects, features and advantages of the present invention will become apparent from the following description of the preferred embodiments with reference to the attached drawings.

BRIEF DESCRIPTION OF THE DRAWINGS

FIGS. 5A and 5B are schematic views for illustrating the relationship between the printer 101 and a discharge tray 306 according to the first embodiment.

FIG. 6 is a block diagram of a facsimile according to a second embodiment showing its detail.

DESCRIPTION OF THE PREFERRED EMBODIMENTS

Embodiments according to the present invention will be described below in detail with reference to the drawings.

(First Embodiment)

According to a first embodiment, a specific example, in which a printer is exemplified, will be described.

Figure 1:
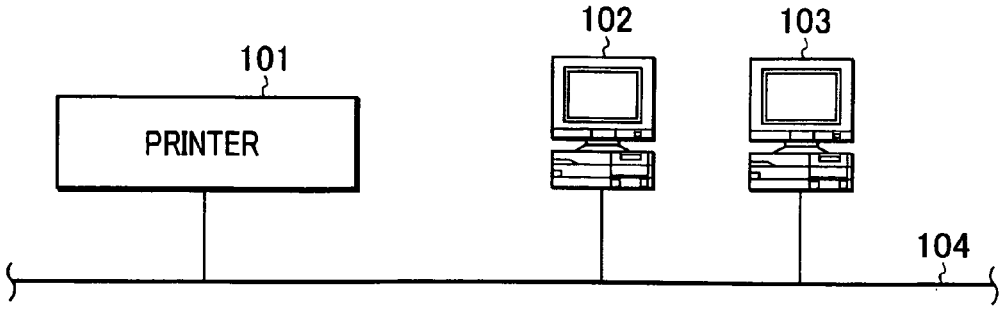
FIG. 1 is a system block diagram for illustrating an environment including a printer 101 according to the present invention.

FIG. 1 is a system block diagram for illustrating an environment including a printer 101 according to the present invention. The printer 101, as shown in FIG. 1, is connected to a plurality of PCs (personal computers) across an LAN (local area network) 104. A user outputs a demand for printing to the printer 101 through PCs 102 and 103.

Figure 2:
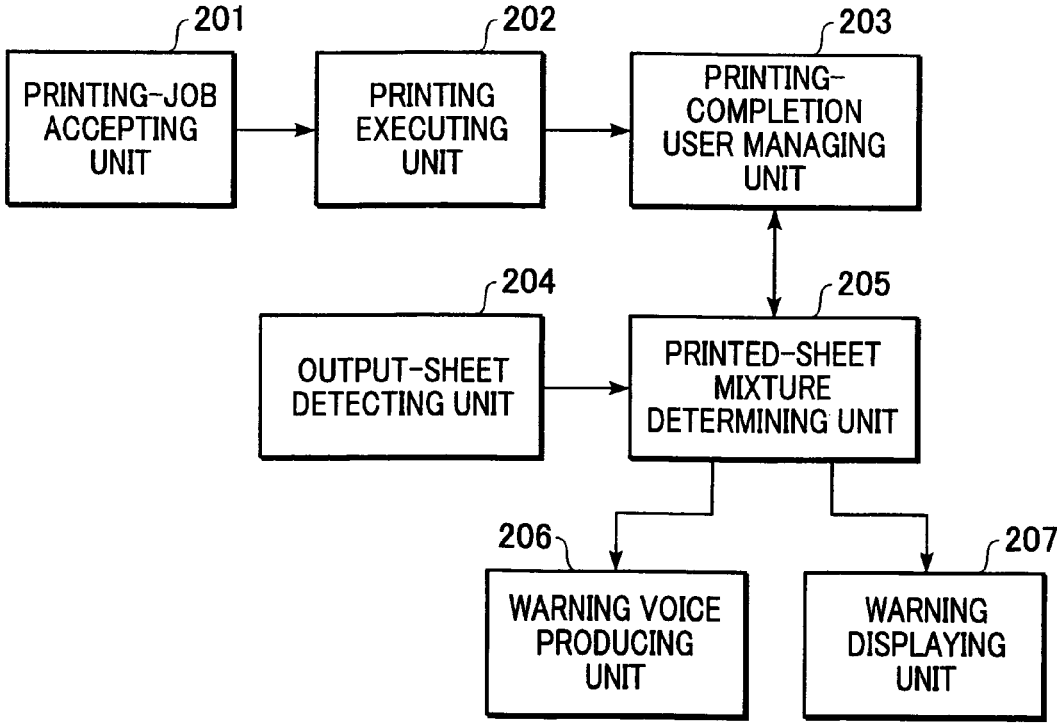
FIG. 2 is a block diagram of the printer 101 according to a first embodiment showing its detail.

FIG. 2 is a block diagram of the printer 101 according to the first embodiment showing its detail. Referring to FIG. 2, a printing-job accepting unit 201 accepts a demand for printing outputted from the PC 102; a printing executing unit 202 executes printing according to the demanded job accepted at the printing-job accepting unit 201 so as to produce an output sheet onto a discharge tray; and a printing-completion user managing unit 203 holds a user name list issuing the demanded printing-jobs that have been executed by the printing executing unit 202.

An output-sheet detecting unit 204 detects the presence of a printed output sheet on the discharge tray of the printer 101, i.e., whether the output sheet is removed from the discharge tray. A printed-sheet mixture determining unit 205 determines the possibility that sheets printed corresponding to a plurality of demands are mixed among the output sheets removed from the discharge tray of the printer 101.

A warning voice producing unit 206 informs with voice a user of the possibility that sheets printed corresponding to a plurality of demands are mixed among the output sheets removed from the discharge tray of the printer 101. Also, on a display such as a monitor, a warning displaying unit 207 displays the possibility that sheets printed corresponding to a plurality of demands are mixed among the output sheets removed from the discharge tray of the printer 101.

Figure 3:
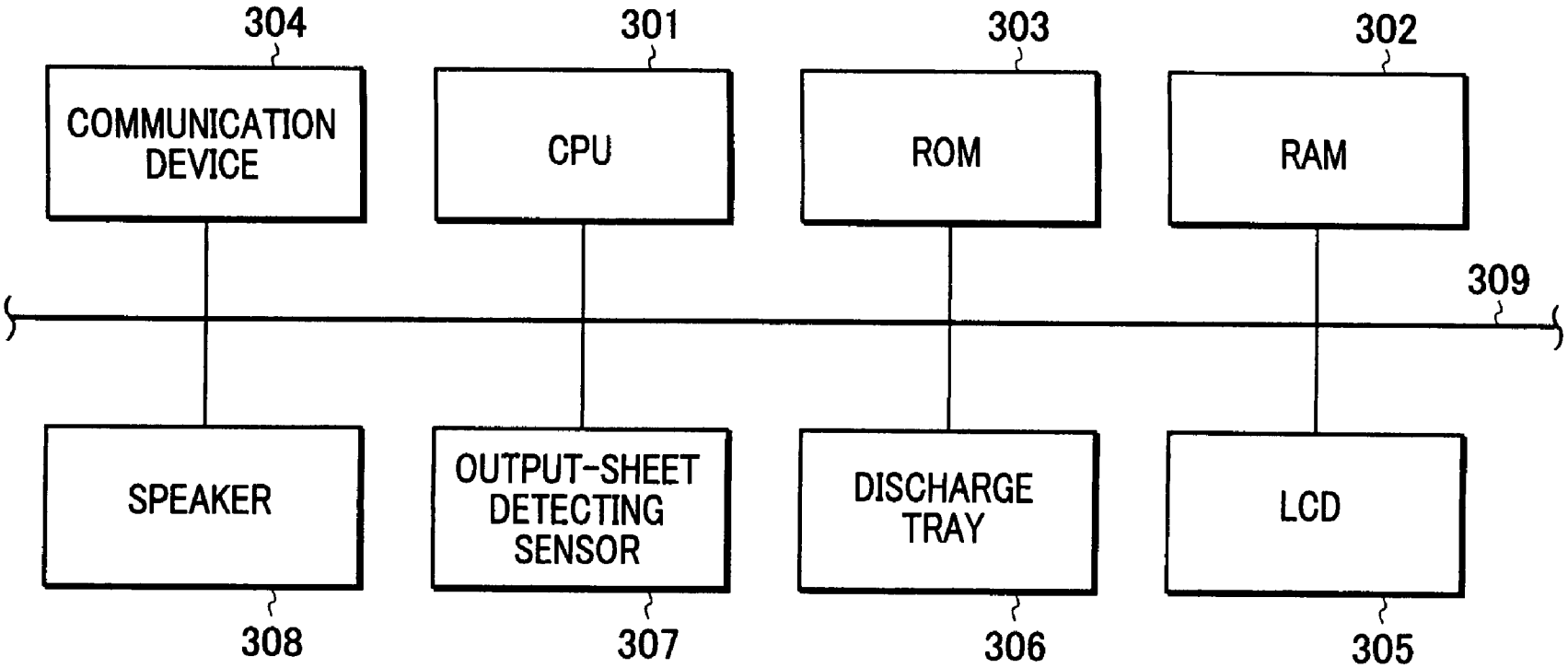
FIG. 3 is a block diagram of a hardware configuration of the printer 101 according to the first embodiment.

FIG. 3 is a block diagram of a hardware configuration of the printer 101 according to the first embodiment. Referring to FIG. 3, a CPU (central processing unit) 301 operates according to a program achieving a procedure, which will be described later; an RAM (random access memory) 302 provides a storage area required for the operation of the program and holds a user name list issuing the demanded printing-jobs that have been executed by the printing executing unit 202 of the printing-completion user managing unit 203; an ROM (read only memory) 303 holds the program achieving the procedure, which will be described later; and a communication device 304 is connected to an LAN (local area network) 104 so as to communicate with various instruments, such as the PCs 102 and 103, connected to the LAN 104.

A liquid crystal display (LCD) 305 displays the state of the printer 101 and the warning with a warning displaying unit 207. A discharge tray 306 is for storing output-sheets printed by a printing executing unit 202. An output-sheet detecting sensor 307 detects the presence of the output-sheet stored on the discharge tray 306, i.e., whether the output sheet is removed from the discharge tray 306. A speaker 308 produces voice including voice outputted by a warning voice producing unit 206 and beep sound. A bus 309 is for connecting the above-mentioned CPU 301, the RAM 302, the ROM 303, the communication device 304, the LCD 305, the discharge tray 306, the output-sheet detecting sensor 307, and the speaker 308 to each other.

The printer 101 and the discharge tray 306 will now be described further. FIGS. 5A and 5B are schematic views for illustrating the relationship between the printer 101 and the discharge tray 306 according to the first embodiment. The printer 101, as shown in FIG. 5A, has one discharge tray 306. The output-sheet detecting sensor 307 is a transmission photo-sensor shown in FIG. 5B, which can thereby detect the presence of a sheet on the discharge tray 306, so that the output-sheet detecting sensor 307 can detect that the output sheet is removed from the discharge tray 306 by the change from the presence of the output sheet on the discharge tray 306 to the absence thereof. Such a detecting method can be achieved by a known technology disclosed Japanese Patent Laid-Open No. 7-267484, for example.

That is, the image-forming apparatus (the printer 101) according to the present invention is characterized in that: a demanded printing-job is accepted at the printing-job accepting unit 201, and the printing executing unit 202 executes printing according to the accepted printing-job demand so as to produce an output-sheet onto the discharge tray; the output-sheet detecting unit 204 detects the presence of a printed output-sheet on the discharge tray; if the absence (removal) of discharged sheets on the discharge tray is detected by the output-sheet detecting unit 204, the printed-sheet mixture determining unit 205 determines the possibility that sheets printed corresponding to a plurality of demands are mixed among the removed output-sheets; and if it is determined by the printed-sheet mixture determining unit 205 that the possibility that sheets printed corresponding to a plurality of the demands are mixed among the output-sheets is present, warning information is produced.

The warning information may be produced with voice by the warning voice producing unit 206. The warning information may also be produced with a screen display by the warning displaying unit 207.

Figure 4:
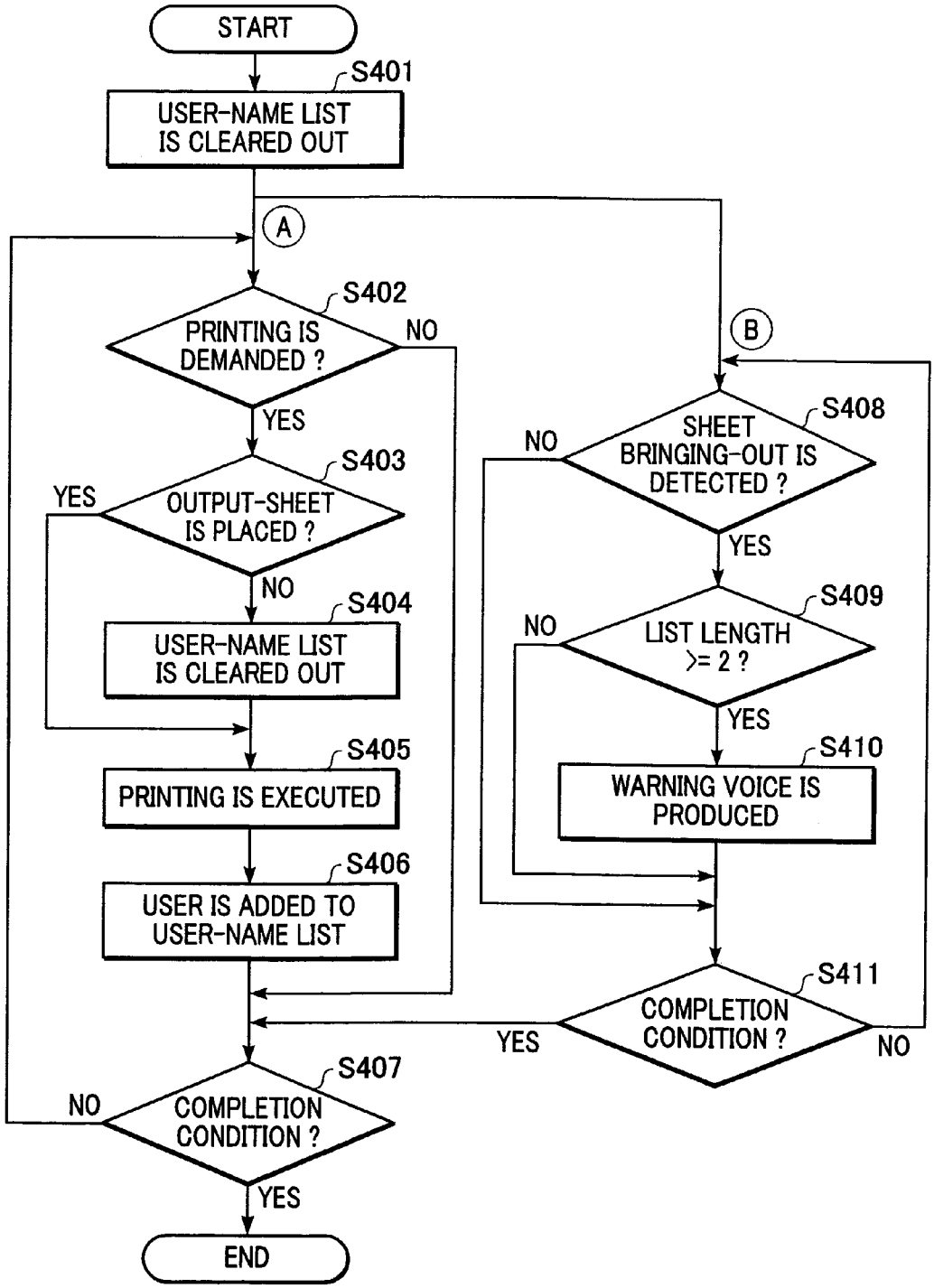
FIG. 4 is a flowchart for illustrating the operation procedure of the printer 101 according to the first embodiment of the present invention.

FIG. 4 is a flowchart for illustrating the operation procedure of the printer 101 according to the first embodiment of the present invention. First, the printing-completion user managing unit 203 initializes its user name list to be cleared out (Step S401). Then, two processes, A and B, are executed in parallel so as to proceed to Step S402 and Step S408, respectively.

In process A, a printing demand from a user is monitored (Step S402). The printing demand includes at least printing data and a user name (an account name on a network, for example) demanding the printing. If printing is not demanded, flow proceeds to step S407 as described below. If the printing is demanded, the output-sheet detecting unit 204 detects whether an output sheet is placed on the discharge tray 306 using the output-sheet detecting sensor 307 (Step S403). On the other hand, if the output sheet is not placed on the discharge tray 306, the user name list is reset and cleared out (Step S404).

In step S405, the printing is executed based on the printing demand. After printing is completed, the name of the user demanding the printing is added to the user name list (Step S406). However, if the name of the user demanding the printing already exists in the user name list, the user name is not added. That is, the user name is not to be repeated in the user name list. Then, the state is checked to determine if it matches with any completion condition, such as pushing a terminating button (Step S407). If the state is not under the completion condition (NO), the above-mentioned process is repeated by returning to the Step S402. If the state is under the completion condition (YES), the process terminates.

In process B, first, the output-sheet detecting sensor 307 detects whether a user is to bring out the output sheet on the discharge tray 306 (Step S408). If it is detected (YES), it is checked whether at least two user names are registered (Step S409). As a result, if two or more user names are registered (YES), since there is the possibility that sheets printed corresponding to the demands by two or more users are mixed among the brought-out output-sheets, this information is informed via a voice warning (Step S410). For example, this voice message is a message such as "Printed sheet for another user may be mixed, please confirm". Flow then proceeds to step S411 described below.

If nothing is detected in step S408 or if in step S409 less than two names are registered, flow proceeds to step S411. In step S411, the state is checked to determine if it matches with any completion condition, such as pushing the terminating button. If the state is not under the completion condition (NO), the same process is repeated by returning to the Step S408. In such a manner, by process B, a user can be informed of the possibility of the mixture of the printed sheet for another user among the output sheets just brought out. Since the warning from the printer 101 is audible information, even a visually impaired user can be aware of the possibility of the mixture of the printed sheets for plural users. By contrast, if the warning from the printer 101 is not produced, since there is no possibility of the output sheet mixture, a user can bring the output at one's own ease, even if the user is visually impaired.

That is, the image-forming apparatus (the printer 101) according to the present invention is characterized in that: the printing-completion user managing unit 203 holding a user list issuing demanded printing jobs further includes the printing-completion user managing unit 203; before the printing execution by the printing executing unit 202, if the absence of the output sheet on the discharge tray is detected by the output-sheet detecting unit 204, the printing-completion user managing unit 203 resets its user list; and if the output-sheet detecting unit 204 detects the absence (removal) of the output sheet when the printing-completion user managing unit 203 has the list of two or more users, the printed-sheet mixture determining unit 205 determines the possibility of the mixture of the printed sheets demanded by plural users among the removed output sheets.

(Second Embodiment)

According to the first embodiment described above, the output-sheet mixture is determined using the user name list demanding printing. In the case of the printer as the image-forming apparatus, the printing demand includes a user name, and the user demanding the printing generally brings out one's own output sheet, so that such output-sheet mixture can be determined. However, in the case of a facsimile, even sending information corresponding to the printing demand includes the sender's information, but does not generally include the information of a receiver, who generally brings out one's own output sheet. In this case, the output-sheet mixture cannot be determined as described in the first embodiment. Consequently, a second embodiment, in which a facsimile is assumed as the image-forming apparatus, will be described.

FIG. 6 is a block diagram of a facsimile according to a second embodiment showing its detail. Referring to FIG. 6, a printing-job accepting unit 601 accepts a demand for printing outputted from a PC, etc.; a printing executing unit 602 executes printing according to the demanded job accepted at the printing-job accepting unit 601 so as to produce an output sheet onto a discharge tray; and a printing-completion number managing unit 603 holds the number of printed sheets completed by the printing executing unit 602.

An output-sheet detecting unit 604 detects the presence of a printed output sheet on the discharge tray of the facsimile. A printed-sheet mixture determining unit 605 determines the possibility that sheets printed corresponding to a plurality of demands are mixed among the output sheets removed from the discharge tray of the facsimile.

A warning voice producing unit 606 informs a user via voice notification of the possibility that sheets printed corresponding to a plurality of demands are mixed among the output sheets removed from the discharge tray of the facsimile. Also, on a display such as a monitor, a warning displaying unit 607 displays the possibility that sheets printed corresponding to a plurality of demands are mixed among the output sheets removed from the discharge tray of the facsimile. In addition, the hardware configuration of the facsimile according to the second embodiment may also be achieved by using the block diagram of FIG. 3.

That is, the image-forming apparatus (the facsimile) according to the present invention is characterized in that: a demanded printing-job is accepted at the printing-job accepting unit 601, and the printing executing unit 602 executes printing according to the accepted printing-job demand so as to produce an output-sheet onto the discharge tray; the output-sheet detecting unit 604 detects the presence of a printed output-sheet on the discharge tray; if the absence (removal) of discharged sheets on the discharge tray is detected by the output-sheet detecting unit 604, the printed-sheet mixture determining unit 605 determines the possibility that sheets printed corresponding to a plurality of demands are mixed among the removed output-sheets; and if it is determined by the printed-sheet mixture determining unit 605 that the possibility that sheets printed corresponding to a plurality of the demands are mixed among the output-sheets is present, warning information is produced.

Figure 7:
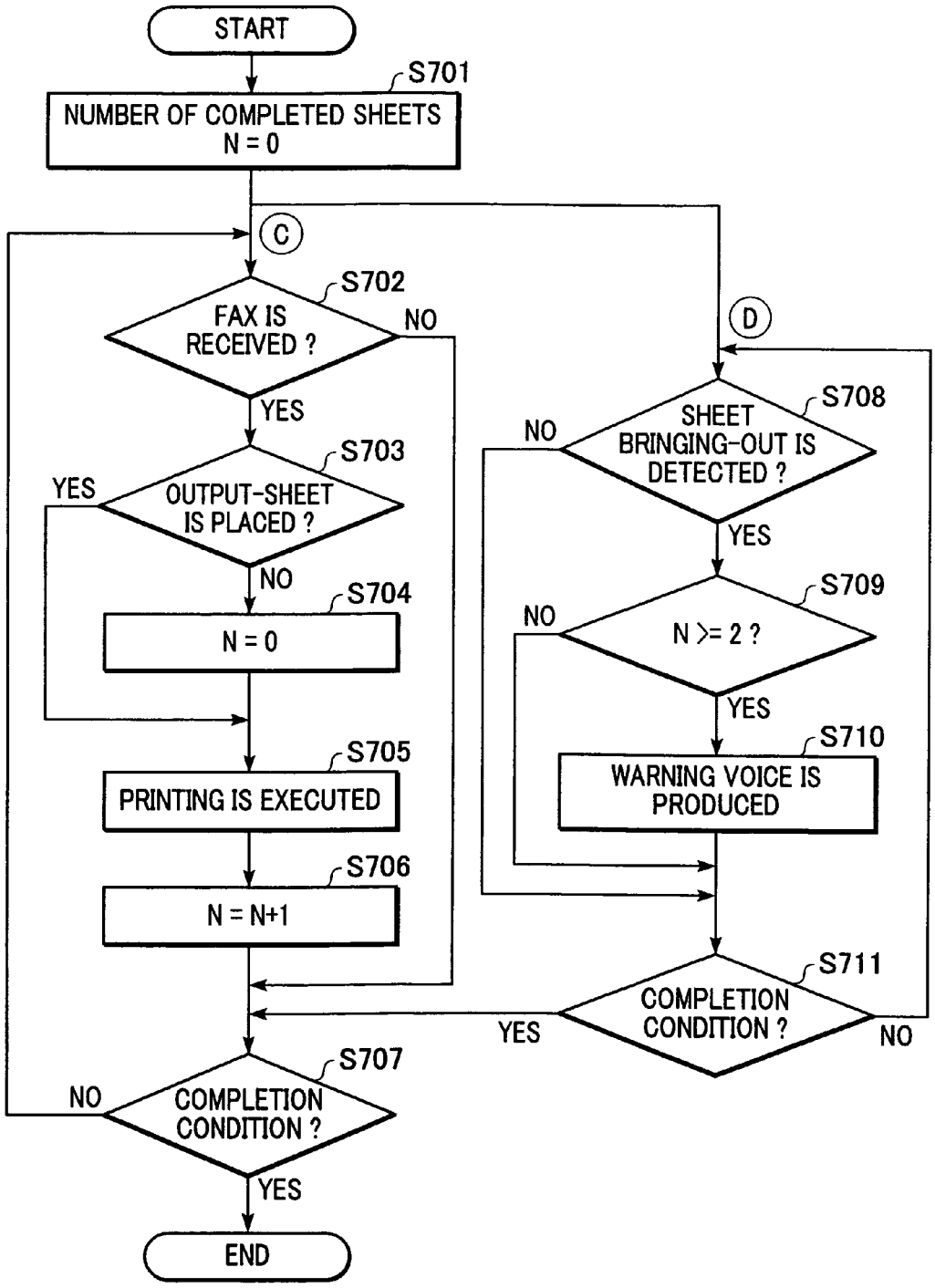
FIG. 7 is a flowchart for illustrating the operation procedure of the facsimile according to the second embodiment of the present invention.

FIG. 7 is a flowchart for illustrating the operation procedure of the facsimile according to the second embodiment of the present invention. First, the printing-completion number managing unit 603 initializes the number of completed printing-jobs N to be zero (Step S701). Then, two processes, C and D, are executed in parallel so as to proceed to Step S702 and Step S708, respectively.

In process C, facsimile receiving is monitored (Step S702). If the facsimile is not received (NO), flow proceeds to step S707 described below. If the facsimile is received (YES), first, the output-sheet detecting unit 604 detects whether an output sheet is placed on the discharge tray (Step S703). As a result, if the output sheet is not placed on the discharge tray (NO), the number of completed printing-jobs N is reset to be zero (Step S704). After the completed printing-jobs N is reset to zero or if the output sheet is placed on the discharge tray (YES), printing is executed based on the received content (Step S705). After printing is completed, the number of completed printing-jobs N is incremented by one (Step S706). Then, the state is checked to determine if it matches with any completion condition, such as pushing a terminating button (Step S707), if the state is not under the completion condition, the same process is repeated by returning to the Step S702. If the state is under completion condition, the process terminates.

In process D, first, it is detected whether a user is to bring out the output sheet on the discharge tray (Step S708). If bringing out is not detected (NO), flow proceeds to step S711 described below. If bringing out is detected by the output-sheet detecting unit 604 (YES), the printed-sheet mixture determining unit 605 checks whether the number of completed printing-jobs N is at least two (Step S709). If the number of completed printing-jobs N is less than two, flow proceeds to step S711 as described below. If N is two or more (YES), since there is the possibility that facsimiles addressed to a plurality of receivers are mixed among the brought-out output-sheets, the warning voice producing unit 606 informs the user of this information via voice notification (Step S710). For example, this voice message is a message such as "Output sheet for another user may be mixed, please confirm".

The state is then checked if to determine if it matches with any completion condition, such as pushing the terminating button (Step S711). If the state is not under the completion condition, the same process is repeated by returning to the Step S708. By process D, a user can be informed of the possibility of the mixture of the outputted facsimile addressed for another user among the output sheets just brought out. Furthermore, since the warning from the printer 101 is audible information, even a visually impaired user can know the possibility of the mixture of output sheets from plural users. By contrast, if the warning from the printer 101 is not produced, since there is no possibility of the output sheet mixture, a user can bring the output sheet as one's own ease, even if the user is visually impaired. In addition, the functions according to the embodiment may also be imparted to the printer 101.

However, according to the embodiment, since the mixture is determined only by the number of outputs, even a plurality of facsimiles addressed for the same receiver are received from the same sender or plural senders, there is the possibility of warning that output sheets addressed for other people are mixed, so that the accuracy is decreased in comparison with the case of the printer according to the first embodiment.

That is, the image-forming apparatus (the facsimile) according to the present invention is characterized in that: the printing-completion number managing unit 603 counting demanded printing-completion jobs as the number of printing-completion jobs is further provided; before the printing execution by the printing executing unit 602, if the absence of the output sheet on the discharge tray is detected by the output-sheet detecting unit 604, the printing-completion number managing unit 603 resets the number of printing-completion jobs held thereby to be zero; and if the output-sheet detecting unit 604 detects the absence of the output sheet when the printing-completion number managing unit 603 holds the two or more printing-completion jobs, the printed-sheet mixture determining unit 605 determines the possibility of the mixture of the printed sheets demanded by plural users among the removed output sheets.

(Other Embodiments)

According to the embodiments described above, voice notification is used for warning that output sheets corresponding to a plurality of demands are mixed. Alternatively, a warning message may be displayed on a liquid crystal display independently or in conjunction with the voice notification. This can be achieved with the warning displaying unit 207 shown in FIG. 2 or the warning displaying unit 607 shown in FIG. 6.

According to the embodiments described above, the program is also held in the ROM 303. However, the present invention is not limited to this, and the invention may be achieved using an arbitrary storage medium or a similarly operating circuit.

In addition, the present invention may be incorporated in a system composed of a plurality of instruments (a host computer, an interface instrument, a reader, and a printer, for example) or in an apparatus composed of one instrument such as a copying machine or a facsimile.

The object of the present invention is also achieved of course by supplying a recording medium (or a storage medium) having software programs recorded thereon for achieving the functions of the embodiments described above to a computer (or a CPU or a MPU (micro processing unit)) of a system or an apparatus so as to read out and execute the program cord stored in the recording medium. In this case, the program cord read out of the recording medium achieves the functions of the embodiments, so that the recording medium having the program cord recorded thereon constitutes the present invention. It is obvious that not only are the functions of the embodiments achieved by executing the program cord read out by the computer, but also that an operating system (OS) operating on the computer executes the entire or part of the processing in practice based on the instruction of the program cord, thereby achieving the functions of the embodiments.

Furthermore, after the program cord read out of the recording medium is written in a memory provided in a feature expansion card inserted in a computer or a feature expansion unit connected to a computer, it is also obvious that a CPU provided in the feature expansion card or the feature expansion unit executes the entire or part of the processing in practice based on the instruction of the program cord, thereby achieving the functions of the embodiments.

In the case where the present invention is incorporated in the above-mentioned recording medium, this recording medium has the program cord stored therein corresponding to the flowchart described above.

As described above, according to the present invention, it can be easily informed that the possibility that output sheets for another person are mixed among the printed output sheets brought out of the discharge tray of the printer, etc., is present.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image-forming apparatus comprising:

accepting means for accepting a print job;

executing means for executing printing according to the accepted print job and producing an output sheet onto a discharge tray;

detecting means for detecting the presence of the printed output sheet on the discharge tray;

determining means for determining whether the discharged output sheets include the output sheets printed based on a plurality of requests or not in case that the detecting means detects the removal of discharged sheets from the discharge tray; and outputting means for outputting warning information if the determining means determines that the discharged output sheets includes the output sheets printed based on a plurality of requests.

2. An apparatus according to claim 1, wherein the outputting means outputs the warning information with voice.

3. An apparatus according to claim 1, wherein the outputting means outputs the warning information with a screen display.

4. An apparatus according to claim 1, further comprising printing-completion user managing means for holding a user list of the print job that have been executed, wherein if the detecting means detects the absence of the output sheet in the discharge tray before the executing means executes printing, the printing-completion user managing means resets the user list, which is held thereby, and wherein if the detecting means detects that the output-sheet is removed from the discharge tray in case that the printing-completion user managing means holds at least two user lists, the determining means determines the discharged output sheets includes the output sheets printed based on a plurality of requests.

5. An apparatus according to claim 1, further comprising printing-completion number managing means for counting the number of the demanded printing jobs that have been executed as the printing-job completion number, wherein if the detecting means detects the absence of the output-sheet in the discharge tray before the executing means executes printing, the printing-completion number managing means resets the number of the executed printing jobs held thereby to be zero, and wherein if the detecting means detects that the output-sheet is removed from the discharge tray and in case that the value of the printing-job completion number held by the printing-completion number managing means is two or more, the determining means determines that the discharged output sheets includes the output sheets printed based on a plurality of requests.

6. An apparatus according to claim 1, wherein the image forming apparatus can be connected to at least one computer for producing the print jobs via a network.

7. An apparatus according to claim 1, further comprising a facsimile function being connectable thereto via a communication line.

8. An image-forming method by an image-forming apparatus, the image-forming apparatus comprising accepting means for accepting a print job and executing means for executing printing according to the accepted print job and producing an output sheet onto a discharge tray, the image-forming method comprising the steps of:

detecting the presence of a printed output sheet in the discharge tray;

determining whether the discharged output sheets include the output sheets printed based on a plurality of requests or not in case that the removal of discharged sheets from the discharge tray is detected by the output-sheet detecting step; and outputting warning information, if it is determined by the determining step that the discharged output sheets includes the output sheets printed based on a plurality of requests.

9. A method according to claim 8, wherein the step of outputting warning information outputs the warning information with voice.

10. A method according to claim 8, wherein the step of outputting warning information outputs the warning information with a screen display.

11. A method according to claim 8, further comprising the step of printing-completion user managing for holding a user list issuing the demanded printing-jobs that have been executed, wherein if the absence of the output sheet in the discharge tray is detected by the detecting step before the executing means executes printing, the printing-completion user managing step resets the user list, which is held thereby, and wherein if the detecting step detects that the output-sheet is removed from the discharge tray and in case that the value of the printing-job completion number held by the printing-completion number managing step is two or more, the determining step determines that the discharged output sheets includes the output sheets printed based on a plurality of requests.

12. A method according to claim 8, further comprising the step of printing-completion number managing for counting the number of the print jobs that have been executed as the printing-job completion number, wherein if the absence of the output sheet in the discharge tray is detected in the detecting step before the executing means executes printing, the printing-completion number managing step resets the number of the completed printing jobs held thereby to be zero, and wherein if the detecting step detects that the output-sheet is removed from the discharge tray and in case that the value of the printing-job completion number held by the printing-completion number managing step is two or more, the determining step determines that the discharged output sheets includes the output sheets printed based on a plurality of requests.

13. A program for allowing a computer, which can be connected to accepting means for accepting a print job and executing means for executing printing according to the accepted print job and producing an output sheet onto a discharge tray, the program for allowing the computer so as to execute the procedures of:

detecting the presence of a printed output sheet in the discharge tray;

determining whether the discharged output sheets includes the output sheets printed based on a plurality of requests or not in case that the removal of discharged sheets from the discharge tray is detected by the output-sheet detecting procedure; and outputting warning information, if it is determined that the discharged output sheets includes the output sheets printed based on a plurality of requests by the determining procedure.

14. A recording medium being readable by a computer, comprising a program according to claim 13 stored therein.

* * * * *